US005722195A

United States Patent [19]

Bentley et al.

[11] Patent Number: 5,722,195

[45] Date of Patent: Mar. 3, 1998

[54] PISTOL GRIP RECOIL SYSTEM FOR THE RECEIVER OF A FIREARM

[76] Inventors: James K. Bentley, 2489 Starling Dr., Paso Robles, Calif. 93446; Willard H. Crawford, 1836 Orange St., Bakersfield, Calif. 93004

[21] Appl. No.: 814,063

[22] Filed: Mar. 10, 1997

[51] Int. Cl.[6] ..... F41C 23/00

[52] U.S. Cl. ..... 42/74; 42/75.03; 42/1.06; 42/71.02; 89/195

[58] Field of Search ..... 42/74, 75.03, 1.06, 42/71.02, 72; 89/195, 196

[56] References Cited

U.S. PATENT DOCUMENTS

| | | | |
|---|---|---|---|
| 2,360,881 | 10/1944 | Lochhead | 42/72 |
| 2,400,349 | 5/1946 | Haberstump | 42/72 |
| 2,435,217 | 2/1948 | Howell, Jr. | 42/72 |
| 3,696,706 | 10/1972 | Seidel et al. | 89/196 |
| 4,048,901 | 9/1977 | Ghisoni | 89/132 |
| 4,594,935 | 6/1986 | Smith | 89/176 |
| 4,930,239 | 6/1990 | Hunter | 42/42.01 |

*Primary Examiner*—Charles T. Jordan
*Assistant Examiner*—Meena Chelliah

[57] ABSTRACT

A pistol grip recoil system for a shotgun or rifle and it has a pistol grip recoil assembly having a recoil base member and a pistol grip. The recoil base member is detachably secured to the rear end of the receiver of the firearm and it has an inverted T-shaped rail formed on its bottom wall. This inverted T-shaped rail is captured within and slides in an inverted T-shaped groove in the top end of the pistol grip. A recess formed in the front wall of the pistol grip adjacent its top end allows the trigger guard of the firearm to travel rearwardly with respect to the pistol grip when the firearm is fired. Various embodiments utilize springs to return the recoil base member forwardly to its static position after dissipating the recoil of the firearm resulting from its being fired.

8 Claims, 2 Drawing Sheets

PISTOL GRIP RECOIL SYSTEM FOR THE RECEIVER OF A FIREARM

BACKGROUND OF THE INVENTION

The invention relates to firearms such as shotguns and rifles and more specifically to a pistol grip recoil assembly for such a firearm.

Present day pistol grips for shotguns and rifles are made of solid material and have no structure for absorbing the recoil of the weapon when it is fired. This lack of absorption of recoil is often painful to the users hands resulting in bruises and black and blue marks. When firing the weapons with a pistol grip, it is difficult to hang onto the pistol grip without getting hurt.

Twelve gauge shotguns are often used for police work and home protection. Replacing the gun's stock with a pistol grip shortens the length of the gun and makes it easier to handle inside a building.

It is an object of the invention to provide a novel pistol grip recoil assembly for shotguns and rifles that is economical to manufacture and market.

It is also an object of the invention to provide a novel pistol grip recoil assembly that can be easily and quickly mounted on the rear end of a conventional receiver of a shotgun or rifle.

It is an additional object of the invention to provide a novel pistol grip recoil assembly that absorbs most of the recoil of the weapon when it is fired.

SUMMARY OF THE INVENTION

The novel pistol grip recoil assembly for a shotgun or rifle absorbs approximately 85% of the recoil of the weapon when it is fired. This prevents injuries to the hand of the person firing the weapon. It also reduces the amount the front end of the weapon kicks upwardly each time it is fired.

The pistol grip recoil assembly is primarily formed of two major components, a recoil base member and a pistol grip. Conventional structure on the front wall of the recoil base member allows it to be removably secured to the rear end of the receiver of a shotgun or rifle. The bottom wall of the recoil base member has a inverted T-shaped rail formed thereon that mates with an T-shaped groove in the top end of the pistol grip. This allows the recoil base member to slide rearwardly with respect to the pistol grip when the weapon is fired. A recess formed in the front wall of the pistol grip adjacent its front end allows the trigger guard to travel rearwardly into the front end of the pistol grip since the receiver and recoil base member travel as a unitary structure.

The spring mechanisms utilized in the different embodiments of the pistol grip recoil assembly dampen the recoil force of the weapon when it is fired and also cause the recoil base member to return to its forward position.

DESCRIPTION OF THE PREFERRED EMBODIMENT

Figure 3:
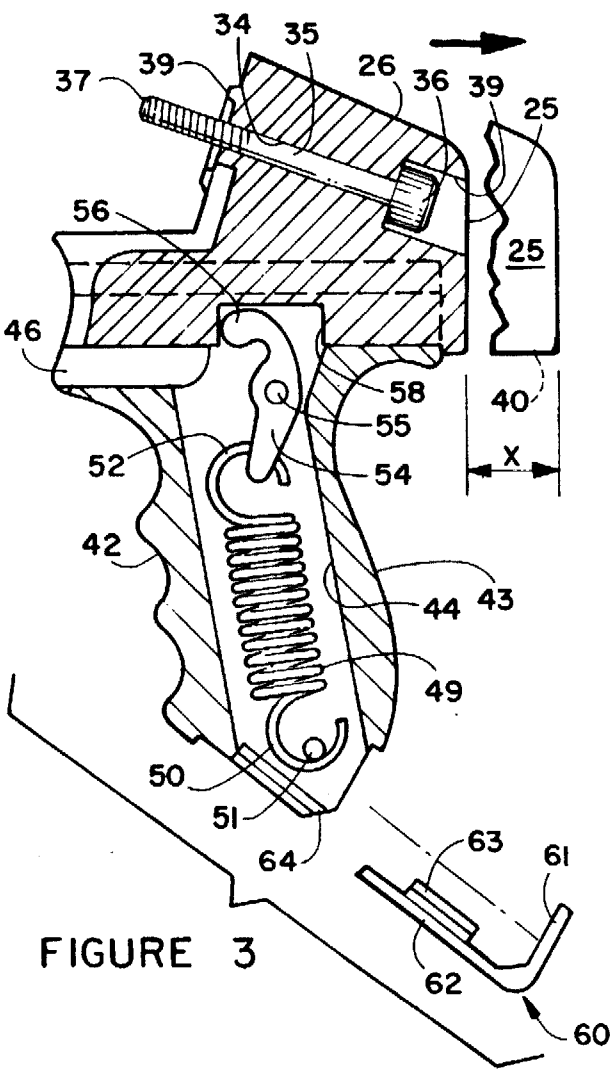
FIG. 3 is a cross sectional view taken along lines 3—3 of FIG. 2 with some of the structure shown in exploded view.
Figure 2:
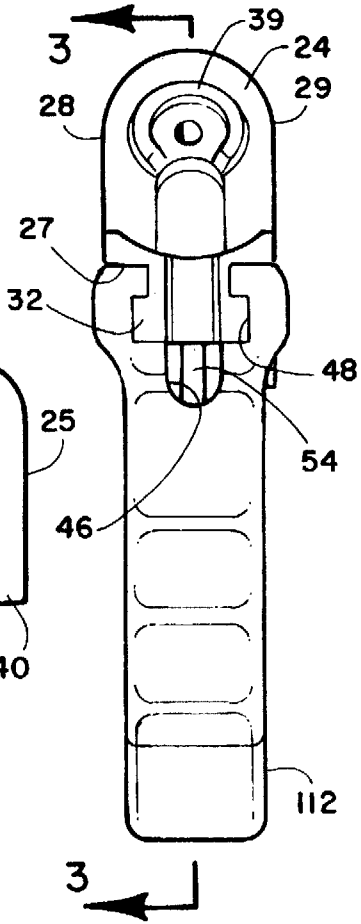
FIG. 2 is a front elevation view of the novel pistol recoil assembly.
Figure 1:
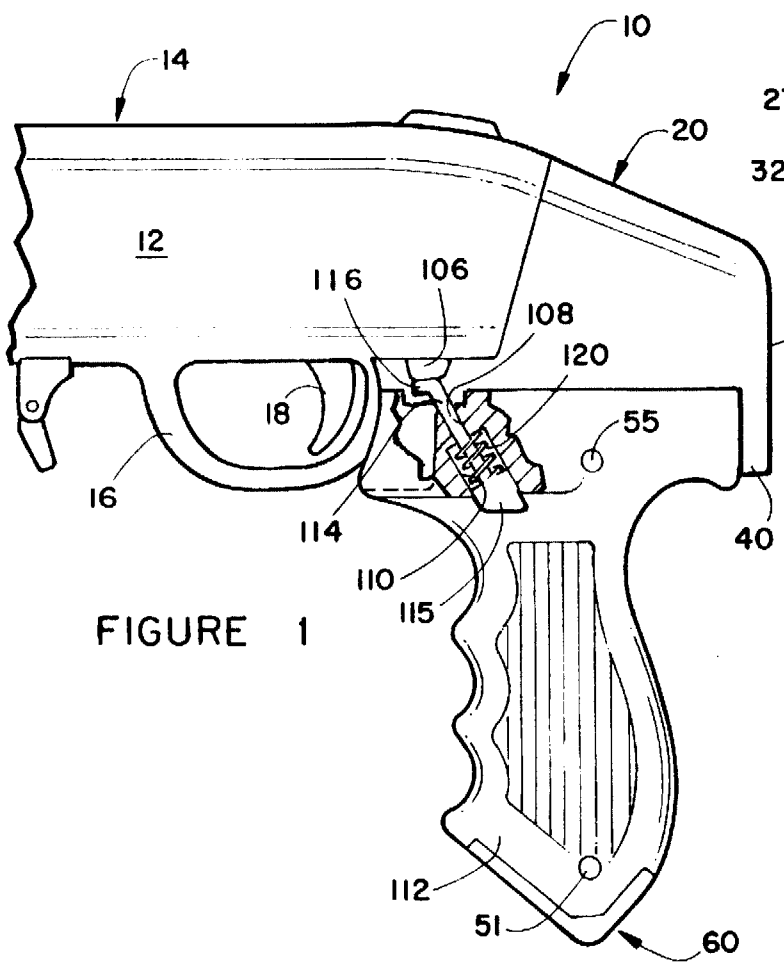
FIG. 1 is a side elevation view of the novel pistol grip recoil system for the receiver of a shotgun or rifle.

The novel pistol grip recoil system for the receiver of a shotgun or rifle will now be described by referring to FIGS. 1–5 of the drawings. FIGS. 1–3 illustrate pistol grip recoil assembly 10 detachably secured to the rear end of the receiver 12 of a rifle or shotgun 14. The firearm has a trigger guard 16 and a trigger 18.

Pistol grip recoil assembly 10 has a recoil block or recoil base member 20 and a pistol grip 22. Recoil base member 20 has a front wall 24, a rear wall 25, a top wall 26, a bottom wall 27 a left side wall 28 and a right side wall 29. An inverted T-shaped rail or slide 32 is formed on bottom wall 27. A bore hole 34 extends longitudinally through recoil base member 20 and it receives a bolt 35 having a head 36 and a threaded shank 37. A countersunk hole 39 provides a receptacle for head 36. Threaded shank 37 screws into conventional structure in the rear end of receiver 12. A ridge 39 on front wall 24 mates with a recess in the rear end of receiver 12. Rear wall 25 has a downwardly extending flange 40.

Pistol grip 22 has a front wall 42, a rear wall 43, and a rectangular chamber 44 extends from its bottom end to its top end. A recess 46 is formed in front wall 42 adjacent its top end so that trigger guard 16 can travel rearwardly as a unitary structure with recoil base member 20 when the firearm is fired. Recoil base member 20 travels a distance X (see FIG. 3) which is normally in the range of ¾ of an inch to 1 inch. The top end of pistol grip 22 has an inverted T-shaped groove or track 48 in which inverted T-shaped rail 32 travels axially. A coil spring 49 has a bottom hook member 50 that is captured by a retainer pin 51. Coil spring 49 has a top hook member 52 that is captured in the bottom end of lever 54. Lever 54 is mounted on a pivot pin 55 and it has a cam member 56 adjacent its top end that is captured and travels in cavity 58 formed in the bottom surface of inverted T-shaped rail 32.

When the firearm is fired, the receiver 12 and recoil block 20 travel rearwardly a distance X with respect to a substantially stationary pistol grip 22. The rearward travel of recoil base member 20 causes lever 54 to rotate clockwise and stretch coil spring 49. This dampens the recoil of the firearm and when its recoil force subsides, coil spring 49 causes lever 54 to rotate counter clockwise and return recoil base member 20 to its forward static position. The bottom end of pistol grip 22 has a bottom cover 60 having a rear wall portion 61 and a bottom wall portion 62. A flange 63 is slidably received in a groove or channel 64 in pistol grip 22.

Figure 4:
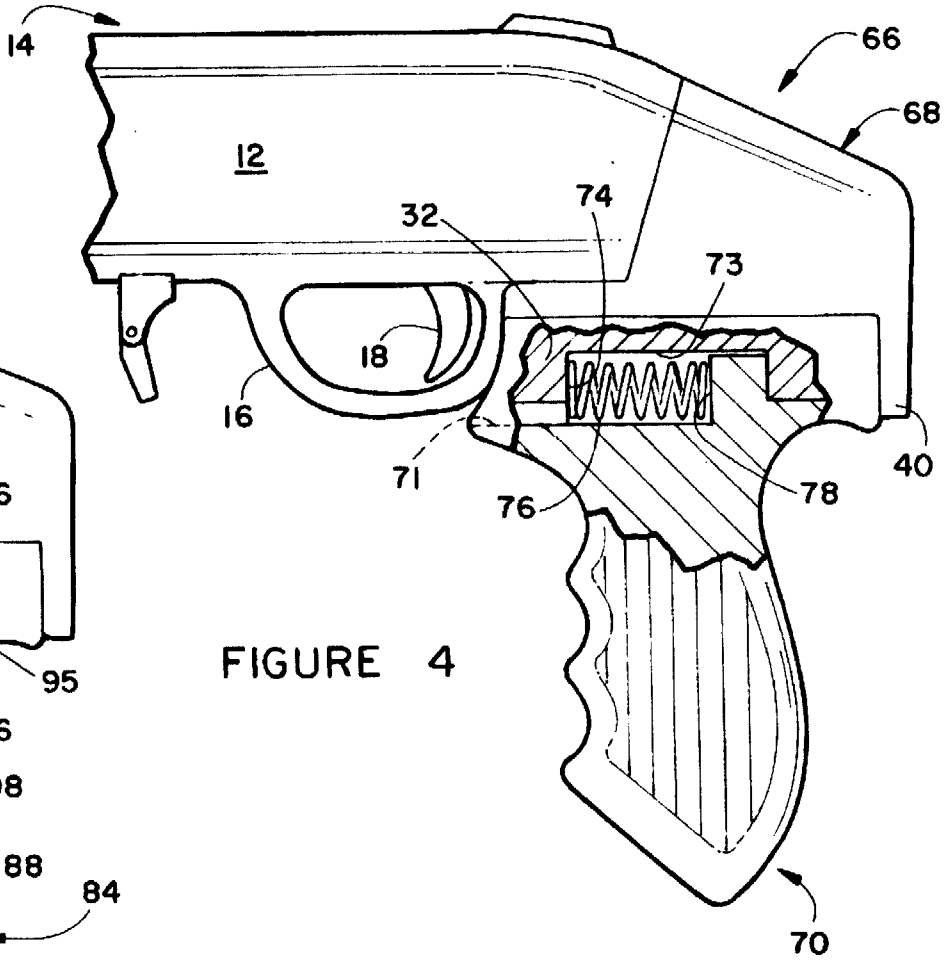
FIG. 4 is a side elevation view of a first alternative embodiment of the pistol grip recoil assembly with portions broken away.

A first alternative embodiment pistol grip recoil assembly 66 is illustrated in FIG. 4. Recoil base member 68 has primarily the same structure as recoil base member 20 with minor exceptions. It has the standard inverted T-shaped rail 32 that mates in an inverted T-shaped groove 48 in the top end of pistol grip 70. A recess 71 is formed in the front wall of pistol grip 70 adjacent its top end for receiving trigger guard 16 as it travels rearwardly. A cavity 73 is formed in the bottom surface of inverted T-shaped rail 32 and it has a front wall 74. A compression spring 76 has its front end positioned against front wall 74 and its rear end positioned against a rear wall 78 formed adjacent the top end of pistol grip 70. The recoil of firearm 14 when it is fired is dampened by compression spring 76 which also returns recoil base member 68 forwardly to its static position.

Figure 5:
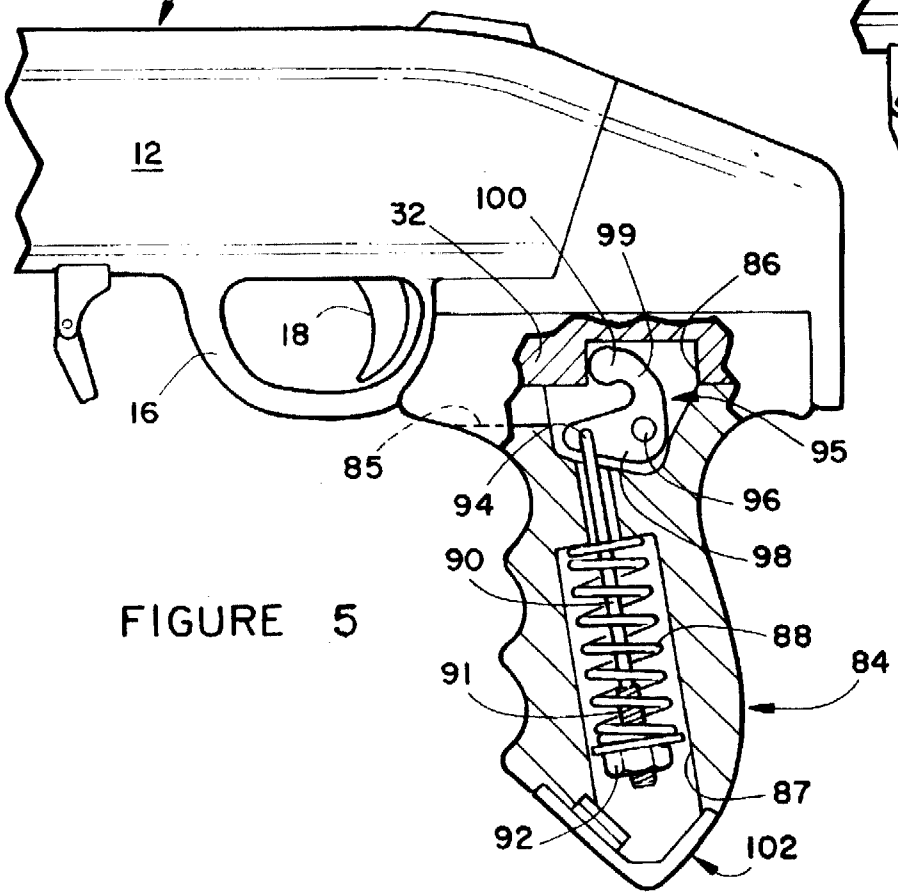
FIG. 5 is a side elevation view of a second alternative embodiment of the novel pistol grip recoil assembly with portions broken away.

A second alternative embodiment pistol grip recoil assembly 80 is illustrated in FIG. 5. It has a recoil base member 82 having the conventional inverted T-shaped rail 32 that travels in inverted T-shaped groove 48 of pistol grip 84. A recess 85 is formed in the front wall of pistol grip 84 adjacent its front end to allow trigger guard 16 to travel rearwardly along with recoil base member 82 when firearm 14 is fired. A cavity 86 is formed in the bottom surface of invented T-shaped rail 32. A cylindrical chamber 87 in pistol grip 84 receives a coil spring 88. Rod 90 has a threaded shank 91 which threadably receives a nut 92. The top end of rod 90 passes through an aperture 94 in bellcrank-type lever 95 that pivots around pivot pin 96. Bellcrank-type lever 95 has a horizontal arm 98 and a vertical arm 99. A cam member 100 is formed on the top end of vertical 99 and it is captured and travels in cavity 86 during the rearward travel of recoil block base member 82. Bottom cover 102 is detachably secured to the bottom end of pistol grip 84 and its structure is identical to that illustrated in FIG. 3.

The safety release mechanism 106 for the different piston recoil assembly is illustrated in FIG. 1. A bore hole 108 and a countersunk bore hole 110 are formed in the left side wall 112 of pistol grip 22. A rod 114 having a head 115 and a leg 116 is positioned in said respective bore holes. A spring 120 keeps leg 116 normally out of contact with safety release mechanism 106.

What is claimed is:

1. A pistol grip recoil system for a receiver of a firearm comprising:

a pistol grip recoil assembly having a recoil base member and a pistol grip;

said recoil base member having a front wall, a top wall, a bottom wall, a rear wall, and laterally spaced left and right side walls;

said pistol grip having a front wall, a rear wall, laterally spaced left and right side walls, a top end and a bottom end;

means for detachably securing the front wall of said recoil base member to the rear end of the receiver of a firearm so that the recoil of said receiver when the firearm is fired is transmitted to said recoil base member;

track means interlocking the bottom wall of said recoil base member to the top end of said pistol grip so that said recoil base member can travel axially rearward with respect to said pistol grip from its static position when the firearm is fired; and means for axially returning said recoil base member forwardly to its static position after dissipating the recoil of the firearm resulting from its being shot.

2. A pistol grip recoil system for the receiver of a firearm as recited in claim 1 wherein the front wall of said pistol grip has a recess formed adjacent its top end for temporarily receiving the rear end of a trigger guard of a firearm when it is fired and the trigger guard travels rearwardly with respect to said pistol grip.

3. A pistol grip recoil system for the receiver of a firearm as recited in claim 1 wherein said means for detachably securing said recoil base member to the rear end of the receiver of a firearm comprises: a bore hole extending through said recoil base member from its front wall to its rear wall and a bolt extending through said bore hole to be screwed into the rear end of a firearm receiver.

4. A pistol grip recoil system for the receiver of a firearm as recited in claim 1 wherein said track means comprises an inverted T-shaped rail formed on the bottom wall of said recoil base member and an inverted T-shaped groove formed in the top end of said pistol grip.

5. A pistol grip recoil system for the receiver of a firearm as recited in claim 1 wherein said means for axially returning said recoil base member forwardly to its static position comprises a longitudinally extending cavity formed in the bottom wall of said recoil base member and a longitudinally extending compression spring positioned in said cavity.

6. A pistol grip recoil system for the receiver of a firearm as recited in claim 1 wherein said means for axially returning said recoil base member forwardly to its static position comprises an elongated chamber extending through said pistol grip from its bottom end to its top end; an elongated coil spring having a top end and a bottom end is positioned in said elongated chamber; means for securing said bottom end of said coil spring in said elongated chamber in said pistol grip; a lever having a top end and a bottom end pivotally mounted on a transversely extending pivot pin; means for securing the bottom end of said lever to the top end of said coil spring; the top end of said lever being captured in a cavity formed in the bottom wall of said recoil base member.

7. A pistol grip recoil system for the receiver of a firearm as recited in claim 6 wherein said lever has the configuration of a bellcrank-type lever.

8. A pistol grip recoil system for the receiver of a firearm as recited in claim 6 further comprising a removable bottom cover for covering the bottom end of said elongated chamber in said pistol grip.

* * * * *